United States Patent [19]

Morando

[11] Patent Number: 4,553,691

[45] Date of Patent: Nov. 19, 1985

[54] EGG CARTON ADAPTER

[75] Inventor: E. Donald Morando, Flossmoor, Ill.

[73] Assignee: Queen Anne Candy Company, Hammond, Ind.

[21] Appl. No.: 639,625

[22] Filed: Aug. 10, 1984

[51] Int. Cl.[4] ..... B65D 5/50

[52] U.S. Cl. ..... 229/2.5 EC; 206/45.14; 206/45.19; 206/15; 206/42

[58] Field of Search ..... 229/2.5 EC, 15, 42; 206/45, 45.11, 45.14, 45.19

[56] References Cited

U.S. PATENT DOCUMENTS

| | | | |
|---|---|---|---|
| 1,961,294 | 6/1934 | Hassell | 229/2.5 EC |
| 2,668,652 | 2/1954 | Russell | 229/2.5 EC |
| 2,759,650 | 5/1956 | Randall | 229/4.5 EC |
| 4,194,682 | 3/1980 | Congleton et al. | 229/4.5 EC |

*Primary Examiner*—Joseph Man-Fu Moy

*Attorney, Agent, or Firm*—Charles F. Pigott, Jr.

[57] ABSTRACT

A two-part egg carton adapter with one part for mounting inside the upper half or top of a standard egg carton to reduce the inside vertical height of the top, and a second part to mount in the base of a standard egg carton to reduce the depth of the plurality of divided pockets therein, the adapter serving to modify a standard egg carton to permit use of such a carton as a container for individual pieces of candy which are substantially smaller than the usual egg.

4 Claims, 7 Drawing Figures

EGG CARTON ADAPTER

BRIEF SUMMARY OF THE INVENTION

The present invention relates to an adapter for modifying a standard egg carton to reduce the internal dimensions thereof and thereby adapt the carton for use as a container for individual pieces of candy which are substantially smaller in size than the eggs for which the carton was designed.

This invention is especially intended for use to adapt a standard egg carton for use as a container for chocolate Easter eggs and the like. Such candy eggs are normally sold only on a seasonal basis, and it is quite expensive to design and produce special cartons for packaging such candy eggs. On the other hand, the usual chocolate or candy Easter eggs are much smaller in size than regular eggs.In fact, such candy eggs are commonly in the form of half eggs with a flat surface on one side.

It is therefore an object of the present invention to provide an adapter which fits inside of a standard egg carton and reduces the internal dimensions of such a carton to adapt it for the packaging of candy Easter eggs and the like which are substantially smaller in size than standard eggs of the type for which the carton was designed.

A more specific object of my invention is to design a two-part adapter with one part dimensioned to fit inside the top or cover of a standard egg carton and the other part dimensioned to fit within the base of a standard egg carton, whereby the two adapter parts cooperate to hold candy eggs or the like within the carton in a firm and secure manner.

The foregoing and other objects and advantages of my invention will be apparent from the following description of a preferred embodiment, taken in conjunction with the accompanying drawings.

Now, in order to acquaint those skilled in the art with the manner of making and using my invention, I shall describe, in conjunction with the accompanying drawings, certain preferred embodiments of the invention.

DETAILED DESCRIPTION OF THE INVENTION

Figure 1:
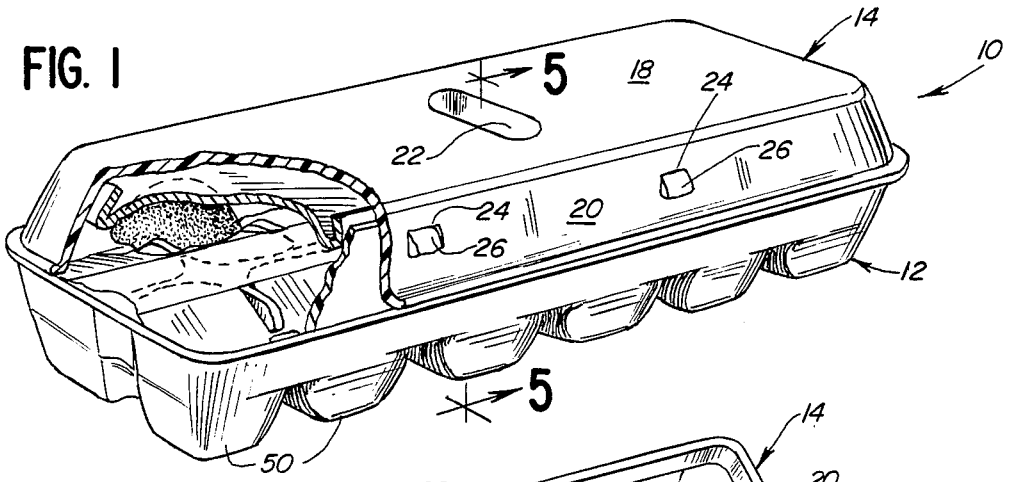
FIG. 1 is a perspective view of a standard egg carton equipped with a two-piece adapter in accordance with the present invention, the top of the carton and the upper part of the adapter being partly broken away.

Referring now to the drawings, there is shown a standard egg carton 10 made of styrofoam or other suitable material, and having a base 12 and an integral cover 14 which is hingedly connected to the base along a hinge line 16. The cover 14 comprises essentially a flat rectangular top wall 18 and four integral depending side walls 20. The top 18 further includes a centrally located depressed portion 12 (see FIG. 2) which projects downwardly from the top wall 18 resulting in a depression at the top of the top wall (see FIG. 1). There are also two generally rectangular openings 24 formed in the front side 20 of the top wall as shown in FIG. 1 to receive projections 26 formed on a flap 27 integral with the base.

Figure 3:
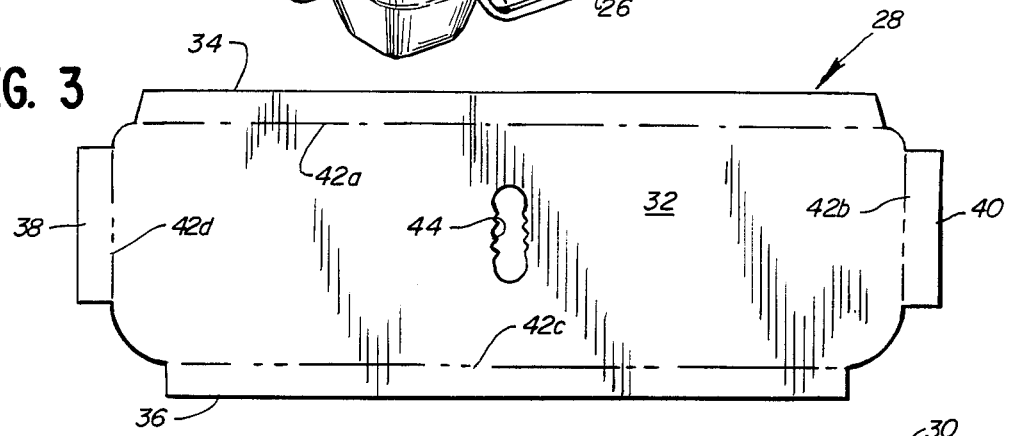
FIG. 3 is a top plan view of one part of the adapter which is designed to fit inside the top or cover of a standard egg carton, the adapter part being shown flat, and dotted lines being used to illustrate crease lines where the adapter is intended to be folded.
Figure 4:
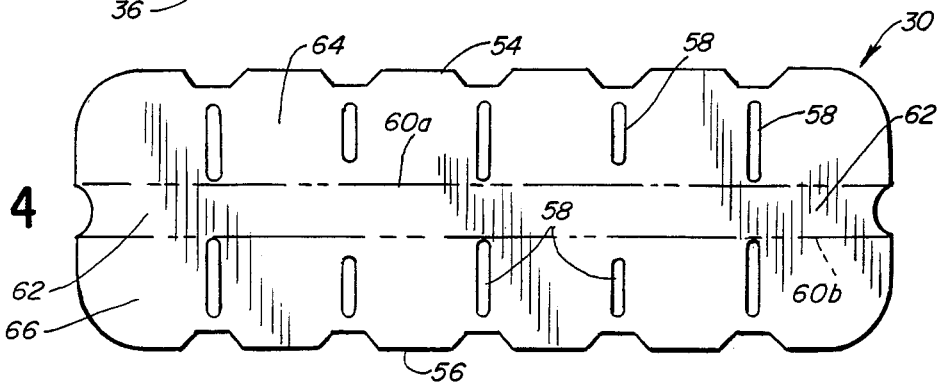
FIG. 4 is a top plan view of a second part of the adapter designed to fit inside the base of a standard egg carton, the adapter part being shown flat, and dotted lines being used to illustrate crease lines where the adapter is intended to be folded.

The adapter part which fits within the top or cover 14 of the egg carton is shown at 28 in FIG. 3. The bottom part 30 of the adapter is shown in FIG. 4. Both adapter parts 28 and 30 are preferably made of cardboard or paper which is flexible but still sufficiently thick to provide support for the candy eggs, or other appropriate material which can be readily cut into a shape as shown in FIGS. 3 and 4 and thereafter bent along designated crease lines or the like.

The top adapter part 28 as shown in FIG. 3 comprises one integral sheet having a center portion 32, two longitudinal flaps 34 and 36, and two end flaps 38 and 40. The part 28 is cut as one integral sheet, and crease lines are formed as shown in dotted lines at 42*a*, 42*b*, 42*c* and 42*d* so that the four flaps may be folded somewhat before the adapter part 28 is inserted into the carton cover 14. In addition, the adapter part 28 is provided with a central elongated opening 44 which preferably has irregular side walls for the purpose of receiving the projection 22 which projects down from the underside of the egg carton top wall 18.

Figure 2:
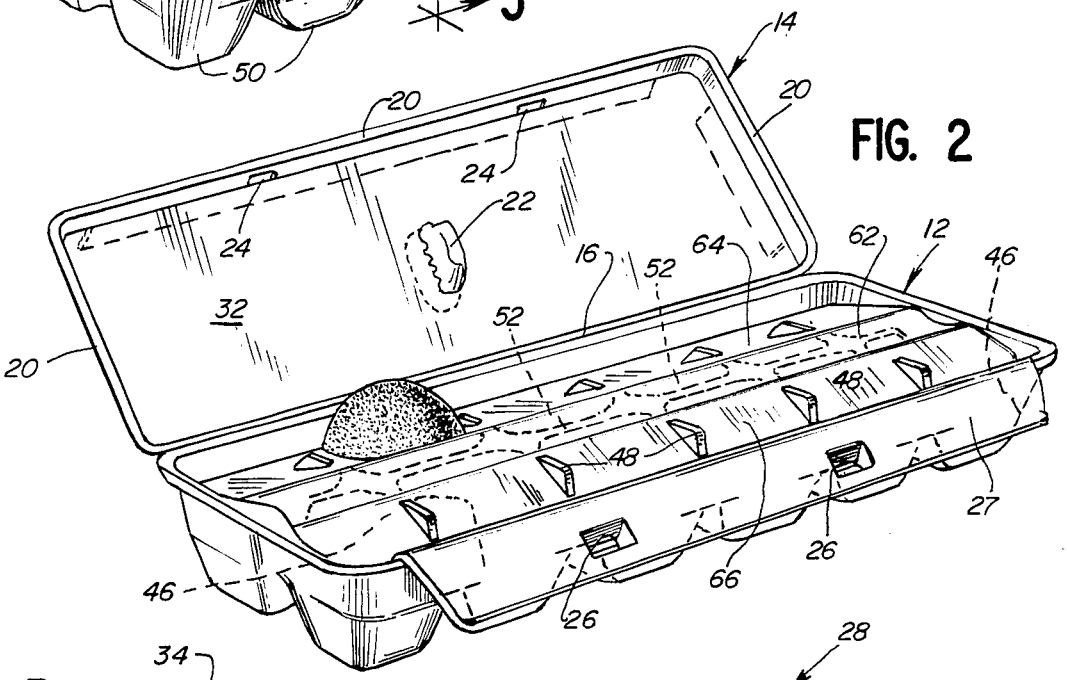
FIG. 2 is a perspective view similar to FIG. 1 with the top or cover of the egg carton shown in an open position.

When the adapter part 28 is to be mounted to the underside of the egg carton cover 14, the flaps 34, 36, 38 and 40 are bent upwardly as shown in dotted lines in FIG. 2, and the adapter part is pressed up into the inside of the cover 14 as shown in FIGS. 1, 2, 5 and 6. The adapter flaps 34, 36, 38 and 40 engage against the four side walls 20 of the cover to frictionally retain the adapter part 28 in position. In addition, the sides of the adapter opening 44 engage against the cover projection 22 to further assist in frictionally retaining the adapter part 28 in position within the underside of the carton cover 14.

Figure 5:
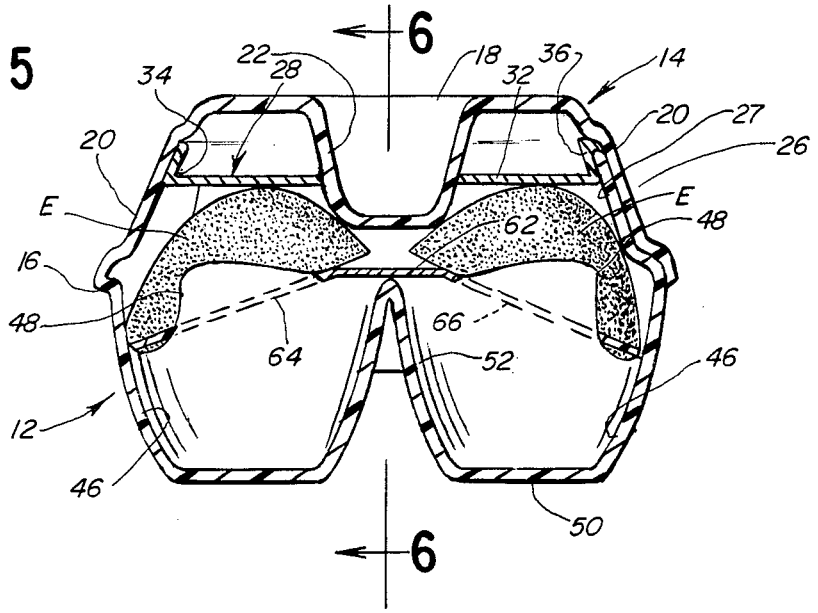
FIG. 5 is an enlarged cross-sectional view taken substantially along the line 5—5 of FIG. 1.
Figure 6:
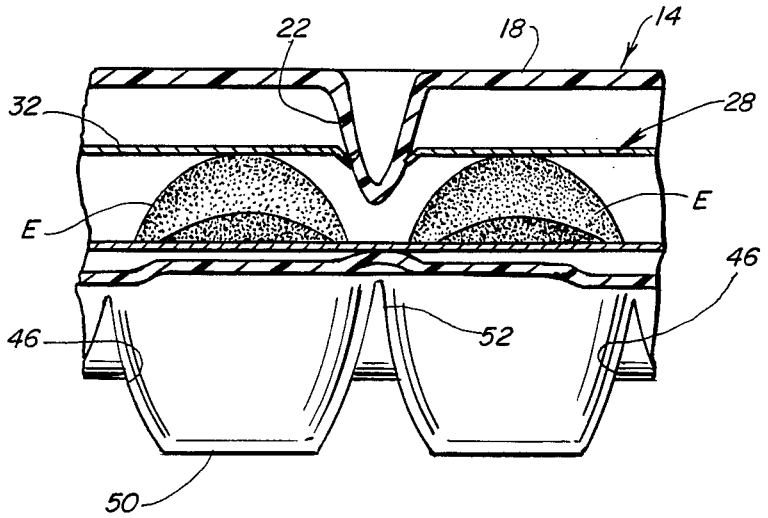
FIG. 6 is a fragmentary cross-section taken substantially along the line 6—6 of FIG. 5.
Figure 7:
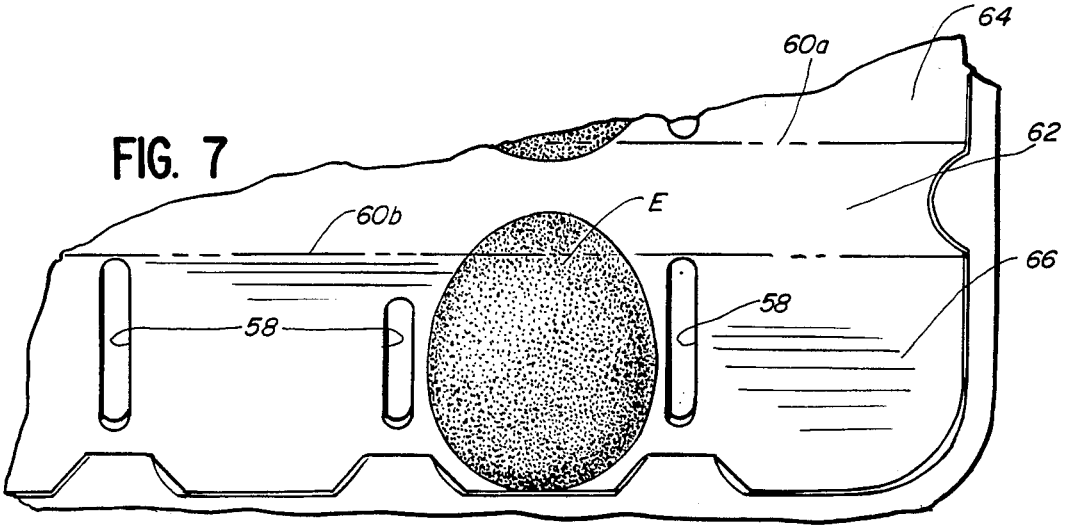
FIG. 7 is a fragmentary top plan view showing the bottom of an egg carton with the adapter of FIG. 4 in place and with a candy Easter egg positioned in one of the compartments defined by the adapter and the carton.

As shown in FIGS. 1, 2, 5 and 6, when the adapter part 28 is mounted inside the cover as described above, the adapter wall 32 is spaced beneath the cover top wall 18, as best shown in FIGS. 5 and 6, thereby to lower the height of the cover top wall and adapt the same for closing down against candy eggs or the like which are smaller in dimension than conventional eggs for which the carton is designed.

The bottom 12 of the conventional egg carton is formed with a plurality of individual compartments or pockets 46 designed to retain individual eggs, there being twelve such pockets provided in the egg carton disclosed herein as is common in the trade. The twelve pockets 46 are separated from one another by divider walls 48 which as best shown in FIG. 5 extend from a height near the top of the carton base 12 to the bottom of the compartments or pockets 46, the bottom of such compartments being shown at 50 in FIGS. 5 and 6. In addition to the divider walls 48 which are transverse to the longitudinal axis of the egg carton, there are also longitudinal divider walls 52, shown in dotted lines in FIG. 2 and in solid lines in FIGS. 5 and 6, which separate the two longitudinal rows of compartments 46.

The second adapter part 30 of FIG. 4 is inserted on top of the egg carton base 12 for the purpose of providing a new floor to each compartment to reduce the depth thereof to accommodate individual candy eggs or the like of a much smaller size than conventional eggs. The bottom adapter part 30 comprises one integral sheet having irregular longitudinal side walls 54 and 56 for the purpose of fitting adjacent the irregular side walls of the carton base 12.

In addition, the adapter part 30 is provided with two longitudinal rows of transverse slots 58 for the purpose of receiving therethrough the transverse divider walls 48 of the carton base 12, as shown for example in FIG. 2. The adapter part 30 is also provided with two longitudinal crease lines shown at 60*a* and 60*b* in FIG. 4, so as to permit the part 30 to be bent along those crease lines, as shown in FIG. 5, prior to mounting of the adapter part 30 on the top of the carton base 12.

As shown in FIGS. 1, 2 and 5, the adapter part 30 is mounted on the top of the carton base 12 so that the center strip 62 of the adapter sits on top of the longitudinal and transverse divider walls 48 and 52, while the two longitudinal side portions 64 and 66 of the adapter part are bent downwardly so the upper ends of the transverse divider walls 48 project upwardly through the plurality of transverse slots 58. In the foregoing manner, the adapter side portions 64 and 66 each serves the purpose of providing a new raised floor or base for the plurality of egg pockets 46, and yet the upper ends of the transverse divider walls continue to define a plurality of twelve individual compartments or pockets in the carton base 12.

FIGS. 1, 2 and 5–7 show the manner in which a plurality of candy Easter eggs E, each in the shape of a half egg with a flat bottom, will fit relatively snugly into new compartments which are defined by the two adapter parts 28 and 30 and the carton transverse divider walls 48. Specifically, the adapter side portion 64 forms a new floor or base for six of the egg compartments 46, divided by the top ends of the walls 48, the adapter side portion 66 forms a new floor or base for the other six egg compartments 46, divided by the top ends of additional divider walls 48, and the adapter wall 32 of the upper adapter part 28 forms a new top of reduced height for each of the twelve compartments 46, so that one candy Easter egg E may be snugly retained in each of the egg compartments defined by the two adapter parts 28 and 30 and the upper portions of the transverse divider walls 48.

I claim:

1. An adapter for fitting within an egg carton to adapt the carton for containing in relatively snug fashion a plurality of candy pieces of substantially smaller size than conventional eggs for which the carton is designed, said egg carton being of the type having two longitudinal rows of a plurality of individual compartments which each receives an individual egg, said carton having a plurality of longitudinal and transverse divider walls to define said compartments, the adapter comprising, in combination, a first adapter part comprising a thin integral sheet of flexible material positioned within the inside of the top of said egg carton and having a center portion which forms a new top for the egg carton of reduced height as compared to the original carton top, and a second adapter part comprising a thin integral sheet of flexible material positioned within the top of the carton base, said second adapter part being folded along two longitudinal fold lines to provide two inclined floors, one floor extending longitudinally along one row of said individual compartments and the other along a second row of said individual compartments, said two inclined floors being of a greater height than the original floors of said individual compartments, and said second adapter part having a plurality of transverse slots for receiving said transverse divider walls therethrough, whereby said first and said adapter parts and the upper ends of said transverse divider walls define a plurality of individual compartments of reduced size for containing in relatively snug fashion a plurality of candy pieces of substantially smaller size than conventional eggs.

2. An adapter as defined in claim 1 where said first adapter part is formed with a centrally located transverse slot for receiving therethrough a transverse depending projection formed on the underside of said egg carton cover.

3. An adapter as defined in claim 1 where said first adapter part is formed with a plurality of flaps on its edges which are folded upwardly for cooperation with side walls of said carton cover to assist in retaining said first adapter part in position within the underside of said cover.

4. An adapter as defined in claim 1 where said second adapter part is formed with a longitudinal central strip and a pair of parallel longitudinal fold lines which separate said central strip from said two inclined floors, said longitudinal central strip being positioned to mount over the top of said longitudinal and transverse divider walls, while said inclined floors extend downwardly therefrom so the upper ends of said transverse divider walls project upwardly above said inclined floors.

* * * * *